United States Patent [19]

Gabler et al.

[11] 4,168,785

[45] Sep. 25, 1979

[54] SCANNER MOUNTING SYSTEM FOR TANGENTIAL FIRED BOILER

[75] Inventors: Joseph F. Gabler, Sparks; J. C. Presley; Howard T. Voorheis, both of Reno, all of Nev.; Hanford N. Lockwood, San Mateo, Calif.

[73] Assignee: Coen Company, Inc., Burlingame, Calif.

[21] Appl. No.: 877,585

[22] Filed: Mar. 24, 1978

[51] Int. Cl.[2] ..... F23M 7/00; F24D 15/04

[52] U.S. Cl. ..... 122/235 B; 110/179; 126/200; 431/13

[58] Field of Search ..... 126/200; 110/179; 122/235 B; 431/13, 79

[56] References Cited

U.S. PATENT DOCUMENTS

| | | | |
|---|---|---|---|
| 2,920,585 | 1/1960 | Grossman et al. | 122/235 |
| 3,021,386 | 2/1962 | Clark | 126/200 |
| 3,075,577 | 1/1963 | Cazalas | 126/200 |
| 3,207,132 | 9/1965 | Miller | 122/235 |
| 3,875,904 | 4/1975 | Astrom | 122/235 |
| 4,043,742 | 8/1977 | Egan et al. | 431/79 |

*Primary Examiner*—Kenneth W. Sprague
*Attorney, Agent, or Firm*—Townsend and Townsend

[57] ABSTRACT

A flame-sensing system for a tangentially fired broiler in which a plurality of scanners are positioned on the side walls of the combustion chamber adjacent respective burners, and oriented to sight the flame from the respective burners, rather than the central fireball. Closely spaced coolant-carrying tubes lining the boiler walls are oriented with at least one tube in a serpentine pattern and with two or three tubes displaced laterally and rearwardly of the flame zone to provide space for a viewing port approximately the width of two tubes. The displacement pattern tends to dissipate the heat load on the scanner port to prevent scanner or boiler case overheating.

15 Claims, 4 Drawing Figures

SCANNER MOUNTING SYSTEM FOR TANGENTIAL FIRED BOILER

BACKGROUND OF THE INVENTION

This invention relates to flame monitoring of boilers with tangential firing, and particularly to a scanner system for monitoring the flames of the individual burners in the tangentially fired boiler.

Tangentially fired boilers are characterized by a combustion chamber which is generally square in horizontal cross-section. The combustion chamber is enclosed by four walls lined with collant-carrying tubes, and the boiler is provided with burners at each corner which fire into a large central fireball. Generally, several different levels or tiers of burners are provided and different fuels are often burned on each level. A liquid heat transfer medium, often water, is circulated through the tubes to remove heat from the furnace. As a secondary effect the medium-carrying tubes sheild the boiler casing to prevent heat damage.

It is desirable to observe the flame of each burner in the boiler to assure that each burner is operating as intended. In the past there have been attempts to employ a flame scanner which sights through the burner wind box at each corner where a small narrow angle opening into the boiler is provided. A scanner mounting system of this type limits the ability of the scanner to see the burner flame. Scanners used in the past employ extended sensing tubes which position the sensor at the furnace end of the burner support and tilting structure (bucket), and employ a flexible mounting assembly in order to allow the sensing tube to tilt with the burner. These sensors required extreme methods of cooling (air or water) in order to maintain the tube temperature below 400° F. The position of the sensor with regard to the burner tip and within the space provisions of the "bucket" caused the sensor to detect flame through the unburned fuel skirt of the burner and could cause the sensor to respond to the radiation from the fireball rather than solely from the associated burner. As a consequence, unignited fuel can be introduced into the furnace resulting in explosions within the furnace under light-off cold furnace conditions.

It has been suggested that scanners be mounted above the burner pods in order to look down on the fireball. However, such a system would not be able to detect a flame-out condition in a tiered, multiple burner boiler, since the scanner would lock onto the fireball and fail to detect a problem with an individual burner within the boiler.

SUMMARY OF THE INVENTION

In order to overcome the foregoing problems and to permit the scanning of each burner in a tangentially fired boiler, a plurality of scanners are positioned at ports located on the side walls adjacent the corner mounted burners. Each scanner is oriented to intersect a diagonal in the horizontal plane of the burner and thus to sight the flame of the associated burner. Closely-spaced coolant-carrying tubes forming the boiler walls are oriented with at least one tube in a serpentine pattern and with two or three tubes displayed laterally and outwardly of the flame zone thereby providing an opening approximately the width of one or two tubes. The spacing and orientation of the tubes minimizes heat load on the scanner port and adjacent boiler casing wall and provides a sufficient viewing angle to permit detection of flame conditions at each burner. Each scanner is capable of repositioning up or down in order to track the movement of the corresponding burner tip. Each scanner is capable of positioning at varying lateral displacements from the burner tip to correspond to the flame front positions associated with different types of fuels. The serpentine tube bend pattern readily accomodates the needed lateral displacement of the scanner.

One object of the present invention is to provide a scanner mounting system for viewing the flame zone of individual burners in order to detect a flame-out condition at any burner.

A further object of the invention is to provide a scanner system which is capable of tracking vertically displacement of individual flames within a boiler assembly.

A still further object of the invention is to provide a suitable scanner port in the side of a tube-walled boiler which provides sufficient cooling of the scanner ports.

Further objects and advantages of this invention will be apparent upon reference to the following detailed description taken in conjunction with the accompanying drawings.

DETAILED DESCRIPTION OF THE PREFERRED EMBODIMENTS

Figure 1:
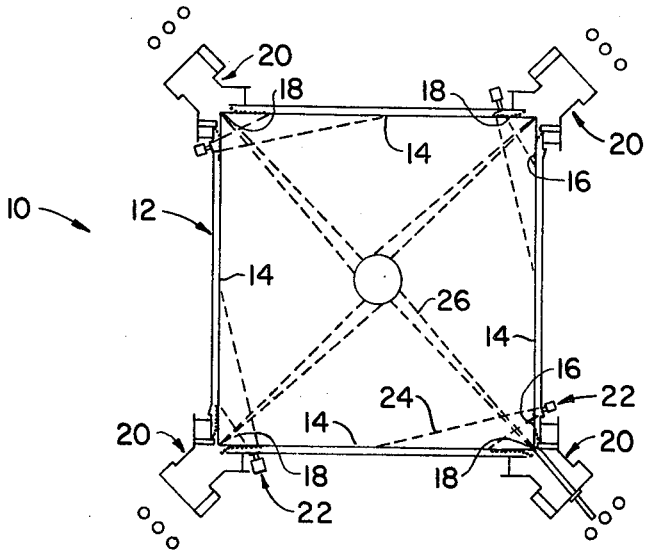
FIG. 1 is a plan view of the furnace illustrating one tier or level of burner assemblies with scanners for viewing individual flame zones.

In FIG. 1, the invention is described in conjunction with a tangentially fired boiler 10 having a square furnace 12 in the plan view. The furnace area is defined by four walls 14 with an array of vertically disposed, closely spaced tubes 16 shielding the walls 14.

Figure 2:
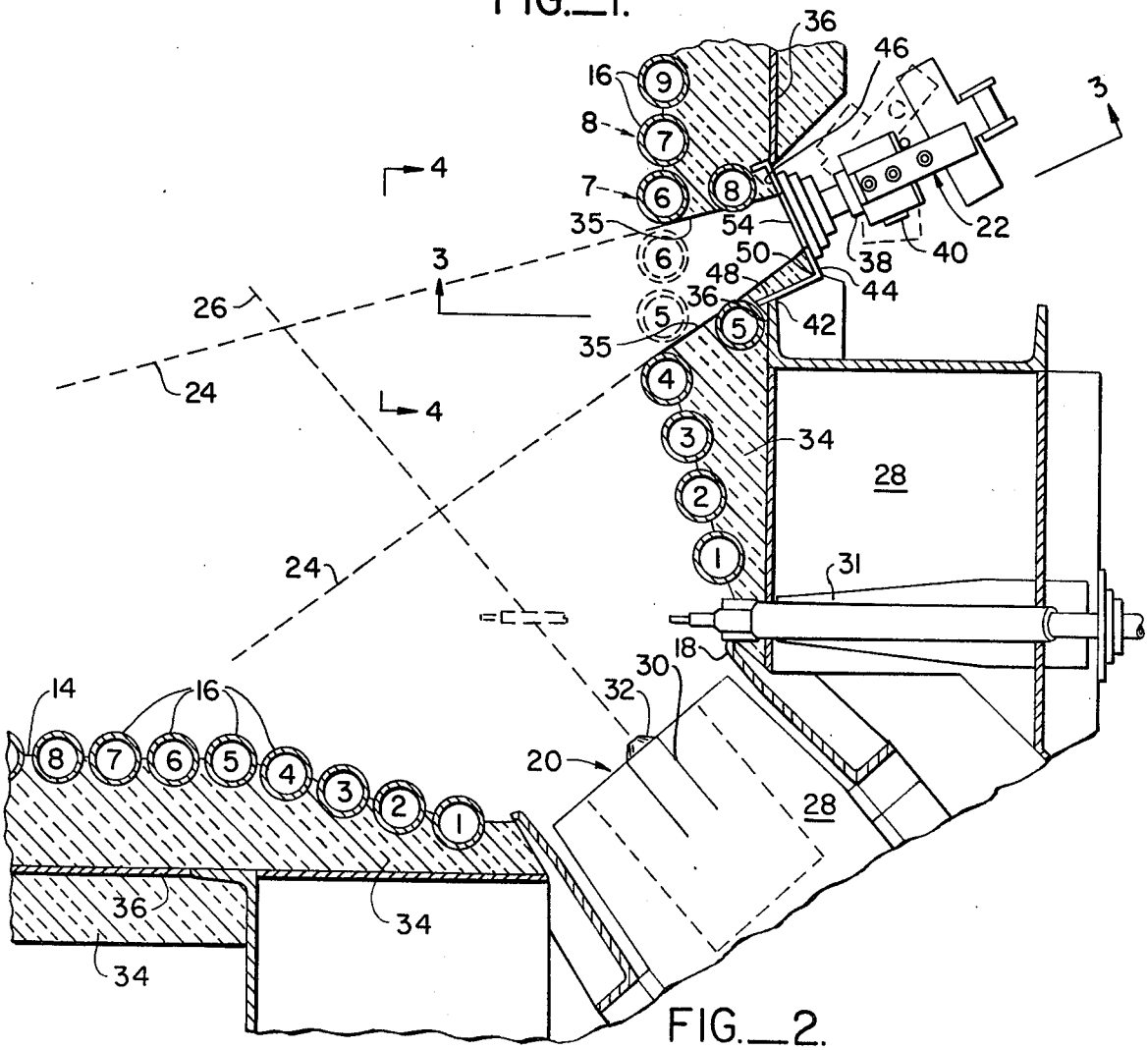
FIG. 2 is a horizontal cross-sectional view of one corner of FIG. 1.

Referring also to FIG. 2, at each corner 18, the tubes 16 are flared slightly outward to admit the outlet of a burner assembly 20. According to the invention, a scanner system 22 is mounted laterally of each corner 18 and provided with a viewing field 24 transverse of the flame path 26 emanating from the respective burner assembly 20.

The burner assembly 20 may include at each level a windbox 28 and one or more burners 30 together with an extendable igniter 31 at each level or tier. Although the exact details of the burner assembly 20 are not pertinent to this invention, it is useful to recognize that the burner assembly 20 may include a fuel nozzle 32 adapted for angular displacement to provide vertical flame travel. In a typical boiler 10, there may be several burner levels each having a similar configuration. For example, one burner level may be adapted to fire oil whereas the adjacent lower or upper burner levels may be adapted to fire coal or gas or the like. Since the firing characteristics and flame length of the various fuels may differ at adjacent levels or tiers, the location of a scanner assembly 22 according to the invention along the side wall 14 at each level may be horizontally displaced from the scanner systems at adjacent levels.

In FIG. 2, the tubes 16 are seen to be so closely spaced as to abut one another. Insulation 34, such as refractory material, is provided directly behind the tubes 16 and on both sides of a boiler casing 36.

Referring particularly to the scanner system 22, a sensor is mounted to a pivotal bracket 40 behind the boiler casing 36. A variety of sensor types are available and may be used in the particular application. In particular, infrared, ultraviolet and other wavelength sensitive sensors or commercially available. An infrared sensor may be used to detect gas or oil flames. Exemplary infrared sensors are sold under the mark Fireye by the Electronics Corporation of America, Cambridge, Massachusetts and are also manufactured by Minneapolis-Honeywell, Minneapolis, Minnesota as Model C7 015A. Ultraviolet sensors may also be used to detect gas or oil flames. Minneapolis-Honeywell and the Electronics Corporation of America also manufacture such ultraviolet sensors. Wavelength sensitive sensors tuned to the near infrared spectrum may be used to detect coal or oil flames. The Electronics Corporation of American and Minneapolis-Honeywell manufacture suitable devices.

Referring again to the structure of FIG. 2, a port 42 may be provided in the side of the casing 36 spaced from the burner assembly 20, and a shaped plate 44 may be seal-selded into the port 42. The plate 44 may comprise two panels 46 and 48 joined at a margin 50 and disposed at approximately right angles along a vertical axis. The first panel 46 may be seal-selded along its side margin to the casing 36 disposed furthest from the burner assembly 20, and the second panel 48 may be selded to the edge of casing 36 nearest the burner assembly 22 so that panel 46 is approximately parallel to the flame path 26 whereas panel 48 is transverse to the flame path 26 and extends outwardly of the boiler casing 36. Panel 46 is provided with a viewing window 54 flexibly coupled with sensor 38. The flexible coupling may be centered on an axis through bracket 40, which may be mounted to panel 46. The relative lengths of panel 46 and 48 establish the horizontal viewing angle of the scanner assembly. Therefore, to change the horizontal angle, the relative lengths need only be adjusted.

Figure 4:
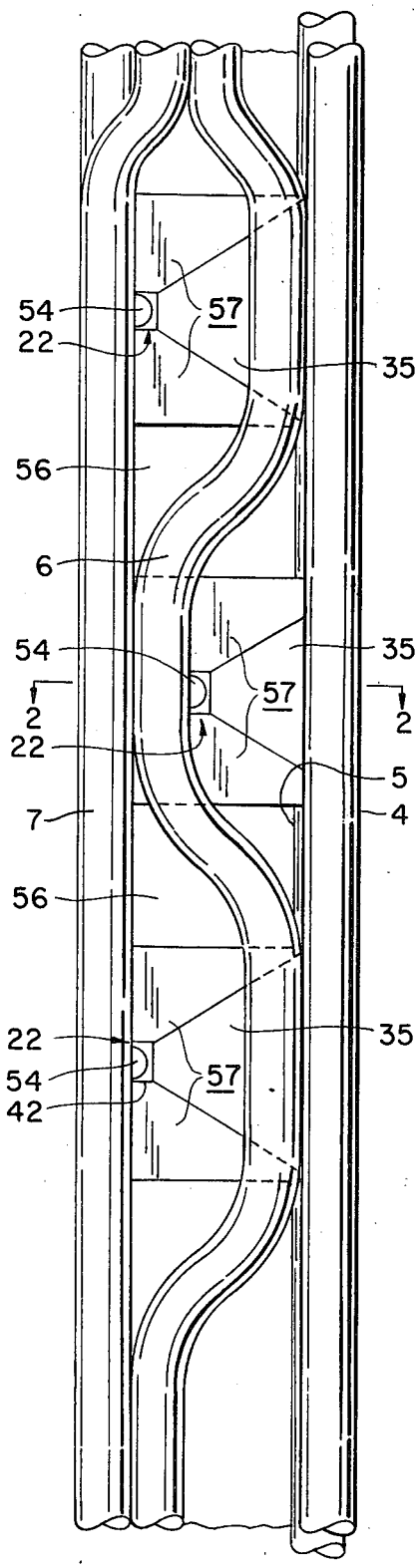
FIG. 4 is a side elevational view along 4—4 of FIG. 2.

For convenience in explaining the displacement of the tubes 16, each is numbered sequentially from the burner assembly 20. Selected tubes are shown in phantom to indicate the location and numbering of the tubes 16 in an unmodified wall section and are shown in solid lines to indicate the location and numbering of tubes in the modified wall section with the desired opening. FIG. 2 will be best understood in conjunction with a reference to FIG. 4. According to the invention, the tubes 15 are displaced in a pattern adopted to produce an opening for the scanner system 22 while minimizing the heat load on the scanner port and casing 36 at the opening. For this purpose, as shown in FIGS. 2 and 4, tube 5 is displaced outwardly from the center of the furnace toward and abutting the boiler casing 36 adjacent the port 42. Refractory material 35 may be packed over tube 5 along the viewing path 24 to provide protective insulation.

Alternatively, tube 5 may be displaced to a location directly behind ahd abutting tube 4. In this dispostion of tubes, tube 4 and tube 5 act as a heat-sink for the casing and port 42.

Tube 8 may also be displaced to the boiler casing 36. For the same vertical length, tube 7 is displaced laterally to the former location of tube 8. At that location, tube 7 abuts tube 9 on one side. Tube 8 is directly behind. Refractory material 35 is packed around tube 8 and along the viewing path 24 as with tube 5.

Tube 6 is also displaced from its normal position. However, tube 6 is displaced in a predetermined serpentine pattern at vertical locations corresponding to the locations of the scanner system 22 at each of the firing levels. For example, at the level shown in FIG. 2, tube 6 is displaced laterally away from the corner 18 to abut tube 7. As shown in FIG. 4, tube 6 is longitudinally extended along the adjacent tube 7 above and below the level of the scanner system 22. At the scanner and burner levels above and below the level of FIG. 2, tube 6 is bent in an opposite sense so that a segment runs adjacent and abutting tube 4.

The tube displacement described above provides a sufficient horizontal width for a field of view of approximately two tube diameters. The location of the scanner system 22 is relatively close to the casing 36 so that a suitably broad field of view of a selected portion of the flame zone is provided.

The field of view, angle of view, and displacement of the scanner 22 from the burner assembly 30 is, however, sufficiently narrow so that no portion of the flame of the adjacent burner assembly at the adjacent corner is in the view of the scanner 22. In other words, only one flame path 26 is in the view field 24 of any single scanner 22.

Tube 6, as it crosses between tube 4 and tube 7, overlies and partially protects a refractory plug 56 between scanner levels. The transverse angle of tube 6 between tubes 7 and 4 may be approximately 45°. The actual minimum angle is not critical for the purposes of this invention. A sharper angle may be employed if sufficient tube length is available and if the level of radiation to which plugs 56 are exposed under segments of tube 6 is sufficiently low. As a practical matter, however, the angle may be somewhat less than 45° since the system of the present invention is typically built into an existing boiler where extreme-angled tube bending may be impractical or inconvenient.

Figure 3:
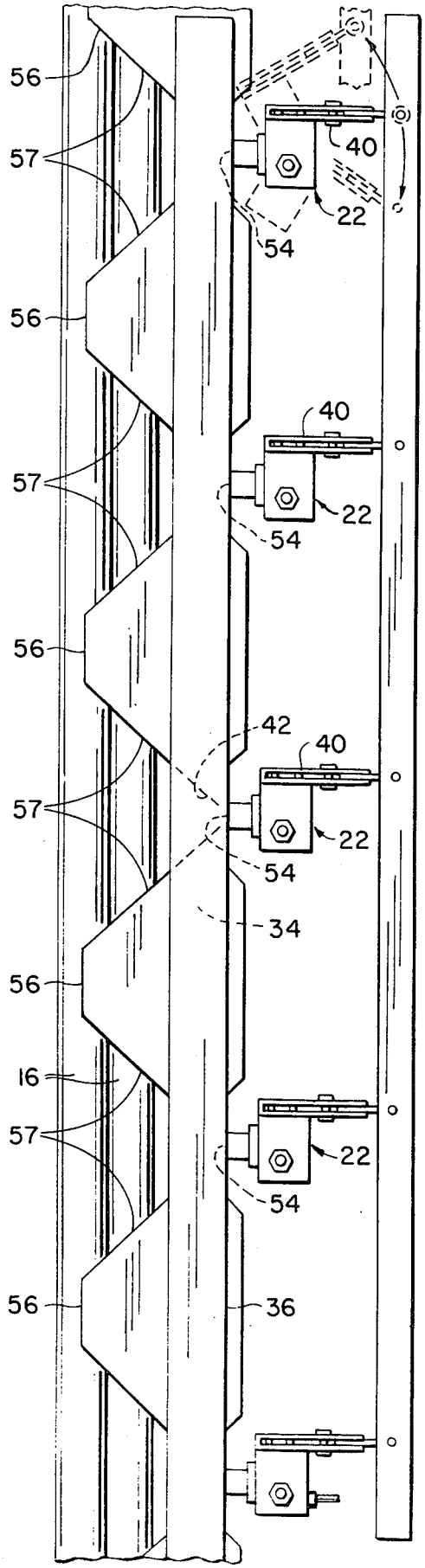
FIG. 3 is a side sectional view along 3—3 of FIG. 2.

Referring now to FIG. 3, there is shown in side elevational view the multilevel arrangements of the scanners 22. The plug 56 of refractory material is seen to be built between the sites of the scanners 22 at each tier and also between each scanner 22 and the array of tubes 16. At each tier, the refractory wall is provided with a vertically wide-angled cut-away viewing area 57 which is adapted to allow the scanner 22 clearance for pivoting in the vertical plane. The insulation 35 is packed along the boiler casing 36 and the tubes 16 adjacent the aperture 54.

The system according to the invention operates as follows. With water or other heat transfer medium flowing through the tubes 16, and a fireball generated within the furnace 12, the scanner 22 at each burner assembly 20 is oriented to view a portion of the flame emanating from the burner assembly 20 at its level across flame axis 26. By remote means (not shown) the scanner 22 may be made to track the flame, should it move vertically within the furnace 12. The fluid flowing through the boiler tubes 16 serves to cool the boiler casing 36 as the heat sink for the scanner ports 42. Tube 6 especially acts as a heat sink for the refractory plugs 56 between levels.

In addition, since the center of the scanner port 42 at each tier is alternately nearer and further displaced from the corner 18 because of the serpentine pattern of tube 6, the scanner 22 for the alternative fuels, generally coal and oil, may be mounted at a characteristic distance from the mouth of the burner assembly 20 to provide each of the scanners 22 with a viewing angle of the desired zone within the flame body to which the scanner is optimally sensitive. For example, since fuel such as gas and oil tend to burn more closely to the nozzle than does a coal fuel, scanners 22 for such fuels are generally located closer to the burner assembly 20 than are the scanners 22 for coal firing nozzles. In this manner, sufficient heat dissipation is provided at the optimal location to cool the scanner ports 42 and the scanners are mounted at the optimal location for viewing a desired flame zone of a variety of burner fuels. Where the optimal combustion zone of alternative fuels at alternating levels differs widely, some latitude in the choice of scanners 22 may be used to compensate for the disparity in available viewing angle. For example, sensors 38 may be chosen which are optimally sensitive to the flame spectrum within the available viewing angle.

The invention has now been explained with reference to specific embodiments. Still other embodiments will be apparent from this description to those of ordinary skill in the art. It is therefore not intended that the invention be limited except as indicated by the appended claims.

What is claimed is:

1. A scanner mounting system for a tangentially fired boiler having a casing lined with an array of generally parallel coolant-carrying tubes and at least one burner comprising:

a plurality of scanner ports defined in said casing spaced in alignment along the length of said tubes, a portion of one of said tubes being displaced laterally in a serpentine configuration alternately on either side and adjacent said scanner ports to expose said scanner ports; and scanner means disposed at said scanner ports and oriented at an intersecting angle to the axis of said burner to sight the flame of said burner.

2. Apparatus according to claim 1 wherein portions of at least two of said tubes are displaced outwardly on respective sides of said scanner port to dissipate the heat load on said scanner ports.

3. Apparatus according to claim 1 comprising adjustable mounting means for mounting said scanner means on said casing at a variable viewing angle relative to the axis of said burner.

4. Apparatus according to claim 1 wherein said scanner means comprises a frequency discriminating infrared scanner sensitive to infrared pulse frequencies, said scanner means being oriented to sight the primary combustion zone of said burner.

5. A scanner mounting system for a tangentially fired boiler having a generally horizontal square cross section casing lined with vertically disposed coolant-carrying tubes and a plurality of burners at the corners of said casing oriented to form a generally central fireball comprising:

a scanner port defined in said casing laterally adjacent one of said burners, a portion of at least one of said tubes being displaced in serpentine configuration adjacent said scanner port to expose said scanner port; and scanner means disposed at said scanner port and oriented at an intersecting angle to the axis of said burner to sight the flame of said burner at a region between said burner and said fireball.

6. Apparatus according to claim 5 wherein portions of at least two of said tubes are displaced outwardly on respective sides of said scanner port to dissipate the heat load on said scanner port.

7. Apparatus according to claim 5 comprising adjustable mounting means for mounting said scanner means on said casing at a variable horizontal viewing angle relative to the axis of said burner.

8. Apparatus according to claim 7 wherein said adjustable mounting means comprises tilt means for varying the vertical viewing angle of said scanner means.

9. Apparatus according to claim 5 wherein said scanner means comprises a frequency discriminating infrared scanner sensitive to infrared pulse frequencies, said scanner means being oriented to sight the primary combustion zone of said burner.

10. A scanner mounting system for a tangentially fired boiler having a generally square horizontal cross section casing lined with a plurality of vertically disposed coolant-carrying tubes and a plurality of burners at each of the corners of said casing arranged in tiers and oriented to form a generally central fireball comprising:

a plurality of scanner ports defined in said casing, each of said scanner ports being laterally adjacent one of said burners, a portion of at least one of said tubes being displaced in serpentine configuration adjacent each of said scanner ports to expose said scanner ports; and a corresponding plurality of scanner means respectively disposed at each of said scanner ports, each scanner means being oriented at an intersecting angle to the axis of the adjacent burner to sight the flame of said burner at a region between said burner and said fireball.

11. Apparatus according to claim 10 wherein portions of at least two of said tubes are displaced outwardly on respective sides of each of said scanner ports to dissipate the heat loads on said scanner ports.

12. Apparatus according to claim 10 comprising adjustable mounting means for mounting each of said scanner means on said casing at variable horizontal viewing angles relative to the axis of said burners.

13. Apparatus according to claim 12 wherein said burner are vertically tiltable and wherein said adjustable mounting means comprises tilt means for varying the vertical viewing angles of said scanner means.

14. Apparatus according to claim 13 comprising means interconnecting said burners and said adjustable mounting means for vertical tracking.

15. Apparatus according to claim 10 wherein said scanner means comprises frequency discriminating infrared scanners sensitive to infrared pulse frequencies, said scanner means being oriented to sight the primary combustion zones of said burners.

* * * * *